US011292244B2

(12) United States Patent
Izume et al.

(10) Patent No.: US 11,292,244 B2
(45) Date of Patent: Apr. 5, 2022

(54) PRINTER DUCTOR ROLLER AND ELECTROMAGNETIC VALVE PROTECTION MEMBER BUILT INTO DUCTOR ROLLER

(71) Applicant: I. MER CO., LTD., Kyoto (JP)

(72) Inventors: Masayuki Izume, Kyoto (JP); Yoshimi Aoyama, Kyoto (JP)

(73) Assignee: I. MER CO., LTD., Kyoto (JP)

( * ) Notice: Subject to any disclaimer, the term of this patent is extended or adjusted under 35 U.S.C. 154(b) by 0 days.

(21) Appl. No.: 16/757,433

(22) PCT Filed: Nov. 19, 2018

(86) PCT No.: PCT/JP2018/042649
§ 371 (c)(1),
(2) Date: Apr. 20, 2020

(87) PCT Pub. No.: WO2019/116831
PCT Pub. Date: Jun. 20, 2019

(65) Prior Publication Data

US 2020/0338881 A1 Oct. 29, 2020

(30) Foreign Application Priority Data

Dec. 14, 2017 (JP) ..... JP2017-239316

(51) Int. Cl.
*B41F 31/26* (2006.01)
*B41F 31/14* (2006.01)

(52) U.S. Cl.
CPC ..... *B41F 31/26* (2013.01); *B41F 31/14* (2013.01); *B41P 2231/10* (2013.01); *B41P 2235/26* (2013.01)

(58) Field of Classification Search
CPC ..... B41P 2231/10; B41F 31/14; F16J 15/50; F16J 15/52
See application file for complete search history.

(56) References Cited

U.S. PATENT DOCUMENTS 4,632,029 A * 12/1986 Simeth ..... B41F 31/14 101/348
5,293,819 A 3/1994 Fukuda
(Continued)

FOREIGN PATENT DOCUMENTS

JP 2001-018357 A 1/2001

OTHER PUBLICATIONS

Official Communication issued in International Patent Application No. PCT/JP2018/042649, dated Dec. 18, 2018.

*Primary Examiner* — Leslie J Evanisko
*Assistant Examiner* — Leo T Hinze
(74) *Attorney, Agent, or Firm* — Keating and Bennett, LLP

(57) ABSTRACT

A ductor roller for printing machines has a shaft provided with an air supply pipe, plural individual ductor rollers, and plural electromagnetic valves, both connected to the shaft. The individual ductor rollers advance pneumatically by the electromagnetic valves. The individual ductor rollers have housings that are associated with the shaft and configured to move forward and backward; roller members configured to contact with the ink fountain roller and an ink distribution roller; and bearings connecting the roller members to the housings. The electromagnetic valves are placed in the housings. Protection members for the electromagnetic valves are oil-resistant, have circularly cylindrical or arc-like covers, and are associated with the shaft. They cover the side ends of the housings and are placed in the clearance between the individual ductor rollers. The protection members do not need an exchange, discharge cleaning liquid for printing machines along troughs and prevent the electromagnetic valves from being contaminated by the cleaning liquid.

5 Claims, 6 Drawing Sheets

(56) References Cited

U.S. PATENT DOCUMENTS 5,688,217 A * 11/1997 Izume ..... B65H 23/048
492/39
6,422,144 B1 7/2002 Izume

* cited by examiner

PRINTER DUCTOR ROLLER AND ELECTROMAGNETIC VALVE PROTECTION MEMBER BUILT INTO DUCTOR ROLLER

FIELD OF THE INVENTION

The present invention relates to a ductor roller for printing machines and, in particular, to protection members of electromagnetic valves installed in the ductor roller.

BACKGROUND ART

Offset printing machines and letterpress machines are provided with a ductor roller between an ink fountain roller and an ink distribution roller; the ductor roller is switched between a state in contact with the ink fountain roller and the other state in contact with the ink distribution roller. The ductor roller receives ink when in contact with the ink fountain roller and delivers the ink when in contact with the ink distribution roller. The contact period of the ductor roller with the ink fountain roller is controlled so that the ink supply amount to the plate cylinder is controlled.

When the ductor roller comprises plural individual ductor rollers and when the individual ductor rollers are controlled so as to independently move forward and backward, the ink supply amount is made finely adjustable in the axial direction of the ink fountain roller (Patent Document 1: JP 3008026B). The individual ductor rollers are associated with a fixed shaft and advance toward the ink fountain roller by pistons that pneumatically advance from the shaft. Further, the individual ductor rollers are biased toward the ink distribution roller by springs and contact pieces and return toward the ink distribution roller when the air supply is shut down. In addition, electromagnetic valves are installed to the fixed shaft for controlling the individual ductor rollers.

When the electromagnetic valves are contaminated by cleaning liquid for printing machines, ink, or other materials, the correct operation of the electromagnetic valves may be impeded. Therefore, Patent Document 1 discloses to provide oil-resistant rubber products for covering clearance between the individual ductor rollers to prevent the cleaning liquid and so on from entering into the clearance. In other words, the rubber products cover the side ends of the individual ductor rollers so as to shut out the cleaning liquid and so on.

PRIOR ART DOCUMENT LIST

Patent Document

Patent Document 1: JP 3008026B

SUMMARY OF THE INVENTION

Problem to be Solved by the Invention

The inventors have found that the oil-resistant rubber products deteriorate by the cleaning liquid for a short period and have to be exchanged frequently.

The object of the invention is to improve the durability of protection members for electromagnetic valves in ductor rollers for printing machines.

Means for Solving the Problem

A ductor roller for a printing machine according to the invention comprises: a shaft provided with an air supply pipe; a plurality of individual ductor rollers; and a plurality of electromagnetic valves. The individual ductor rollers and the electromagnetic valves are connected to the shaft, and the individual ductor rollers are advanced pneumatically by said electromagnetic valves.

In the ductor roller for a printing machine according to the invention, the individual ductor rollers are provided with housings associated with the shaft and configured to move forward and backward; roller members configured to contact an ink fountain roller and an ink distribution roller, both of the printing machine; and bearing members connecting the roller members to the housings, said electromagnetic valves are placed in said housings, and protection members for the electromagnetic valves are placed in clearance between the individual ductor rollers, and are oil-resistant, are associated with and supported by the shaft, and are provided with circularly cylindrical or arc-like covers covering at least upper portions of side ends of said housings. Preferably, the protection members comprise: plate-like portions having association holes that are associated with said shaft; and said circularly cylindrical or arc-like covers.

According to the invention, the covers of protection members cover at least the upper side end portions of the housings and block the cleaning liquid and so on. The covers are circularly cylindrical or arc-like, guide downward the cleaning liquid received by the covers, and prevent the cleaning liquid from reaching the electromagnetic valves. The protection members have a constant shape, do not deform such as rubbers do, and have basically no need for exchange due to their oil-resistance.

Preferably, the covers are circularly cylindrical and have a trough on a circular face of the circularly cylindrical covers, and the trough is low at a central portion of the circularly cylindrical covers and high at side end portions of the circularly cylindrical covers, both in an axial direction of said shaft. The cleaning liquid adhering to the covers flows along the troughs and does not intrude to the electromagnetic valves. Further, the cleaning liquid is discharged to the outside through the clearance between the individual ductor rollers.

Further preferably, a guide for guiding the cleaning liquid for printing machines downward is present at a central portion of the trough in the axial direction. The guide may be a projection or a groove, and the cleaning liquid flows along the guide downward.

Most preferably, at least a projection dropping the cleaning liquid downward is present at a lower end of the trough. The cleaning liquid reached the lower end of the trough concentrates at and drops from the projection and is discharged through the clearance between the individual ductor rollers.

There is such a ductor roller for printing machines that has a shaft provided with an air supply pipe, plural electromagnetic valves, and plural individual ductor rollers, both connected to the shaft. The individual ductor rollers have housings, bearings, and roller members, and the roller members are connected to the housings via the bearings. The individual ductor rollers are advanced toward the ink fountain roller pneumatically by said electromagnetic valves, and the electromagnetic valves are placed in the housings. The protection members according to the invention are suitable for such ductor rollers for printing machines. The protection members are oil-resistant and have association holes for association with the shaft and circularly cylindrical covers that cover at least the upper portions of side ends of the housings of the individual ductor rollers. Further, the circular face of the circularly cylindrical covers is provided with a trough that is lower at the center portion and higher at both end portions in the axial direction of the circularly cylindrical covers. The covers cover at least a side end of the housing and receive cleaning liquid intruding through the clearance between the individual ductor rollers. The cleaning liquid flows downward along the trough and is discharged through the clearance between the individual ductor rollers.

FEATURES FOR CARRYING OUT THE INVENTION

The best embodiment for carrying out the invention will be described.

Embodiment

Figure 1:
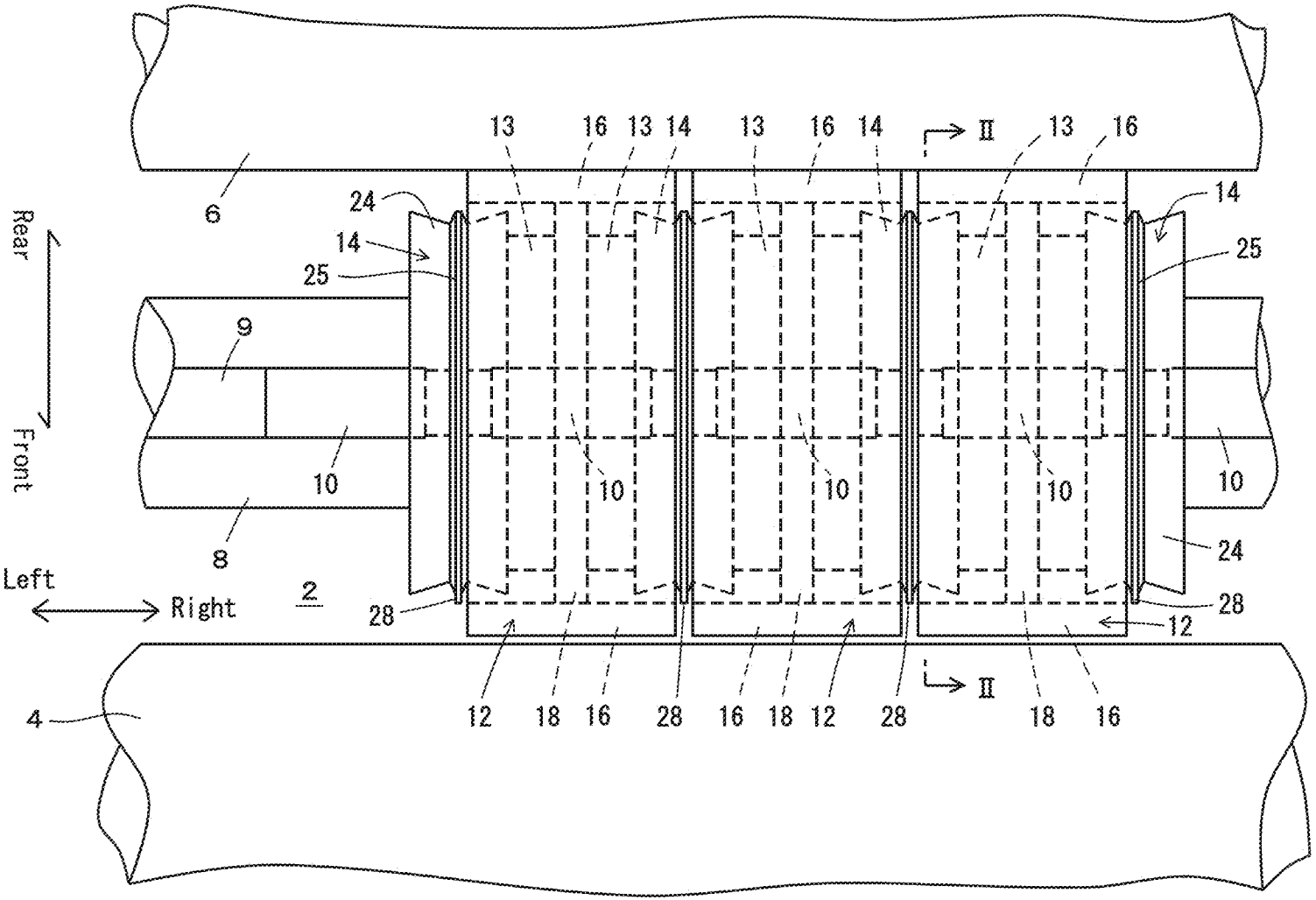
FIG. 1 A view indicating the major portion of a ductor roller according to the embodiment, and partially an ink fountain roller and an ink distribution roller at the forward and the back positions.

FIGS. 1 to 10 indicate the best embodiment and also its modifications. As shown in FIG. 1, a ductor roller 2 according to the embodiment is installed between the ink fountain roller 4 and an ink distribution roller 6, and is provided with a fixed shaft 8 and a plurality of individual ductor rollers 12 connected to the shaft. Further, in a groove 9 on the upper face of the shaft 8, plural electromagnetic valves 10 are placed for each of the individual rollers 12. Between a pair of the individual ductor rollers 12 and 12, a protection member 14 is associated with the shaft 8, covers the side ends of the housings 13 of the individual ductor rollers 12, and is placed in the clearance between the individual ductor rollers 12 and 12. In addition, since a row of the individual ductor rollers 12 are installed on the shaft 8, the protection members 14 are preferably installed also at both ends of the row of the individual ductor rollers 12.

Figure 2:
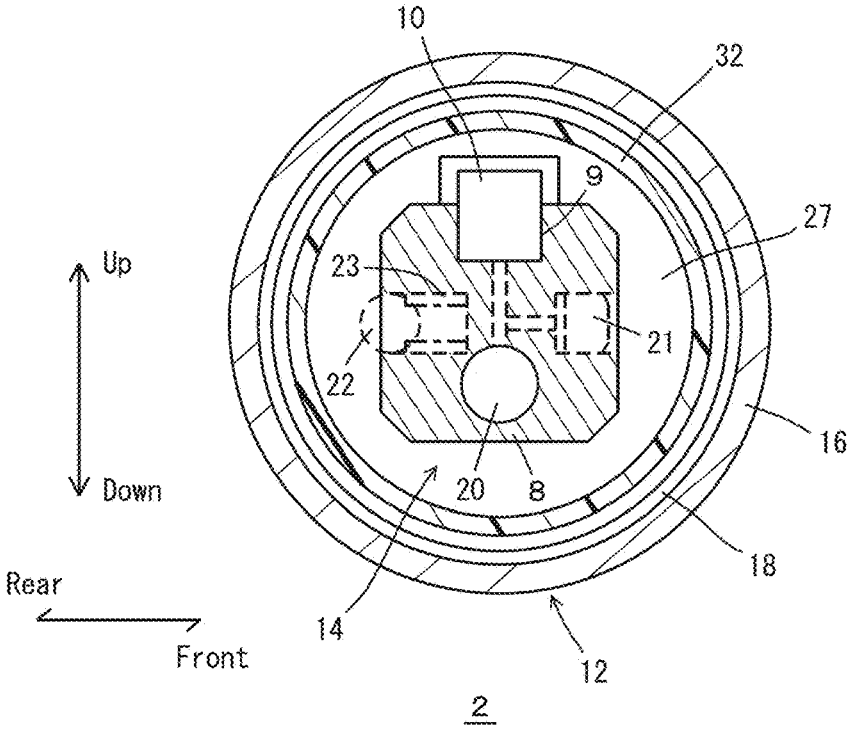
FIG. 2 A vertical cross-sectional view of the ductor roller in the II-II direction in FIG. 1.
Figure 3:
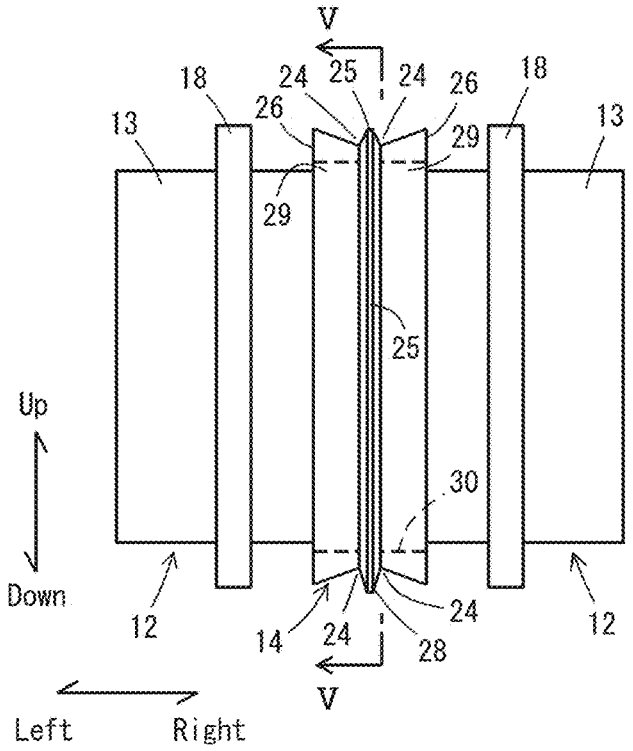
FIG. 3 A view indicating a protection member according to the embodiment and housings of individual ductor rollers.

As shown in FIGS. 2 and 3, each of the individual ductor rollers 12 is provided with a roller member 16 at the outer circular periphery, the roller member is fixed to the housing 13 via a bearing 18, and the housing 13 is associated with the shaft 8. The shaft 8 is provided with a pipe 20 for supplying air, and a piston 21 moves forward and backward pneumatically by the electromagnetic valve 10. At the opposite side of the shaft 8 to the piston 21, a contact piece 22, for example, spherical and a spring 23 are provided, and they make the individual ductor roller 12 biased toward the ink distribution roller 6. Furthermore, one electromagnetic valve 10 is installed for each of the individual ductor rollers 12, is covered by the housing 13, and controlled by a controller not shown.

The individual ductor rollers 12 advance pneumatically toward the ink fountain roller 4 and retract by the springs 23 and the contact pieces 22 toward the ink distribution roller 6. The directions in the specification are shown in FIGS. 1 and 2. The up and down direction is determined according to the ductor roller 12 installed in a printing machine, and, according to the embodiment, the electromagnetic valves 10 are at the upper portion of the shaft 8. Further, the front indicates the side of the ink fountain roller 4, and the back indicates the side of the ink distribution roller 6. The left and right direction is parallel to the lengthwise direction of the shaft 8. The axial direction is the same to the left and right direction and means the lengthwise direction of the shaft 8. The protection member 14 is circularly cylindrical, the circular direction of the cylinder is simply called the circular direction, and the axial direction of the circular cylinder is simply called the axial direction.

FIG. 3 indicates the protection member 14 and the housings 13 of the left and right individual ductor rollers 12 and 12. The protection member 14 comprises an oil-resistant material, such as steel, aluminum, or oil-resistant polymer resin and, according to the embodiment, for weight reduction, it comprises an oil-resistant polymer resin such as nylon or fluoropolymer. The oil-resistance of polymers are remarkably different between rubbers, which are easily deformable, and resins, which have a constant shape, even if they comprise the same monomer. Resins such as nylons, fluoro resins, polycarbonate resins, phenol resins, unsaturated polyester resins, and furan resins have excellent oil-resistance. The protection member 14 covers the side ends of the housings 13 and prevents contamination matters such as cleaning liquid from entering into the housings 13. The protection member 14 according to the embodiment has practically no need for exchange.

Figure 4:
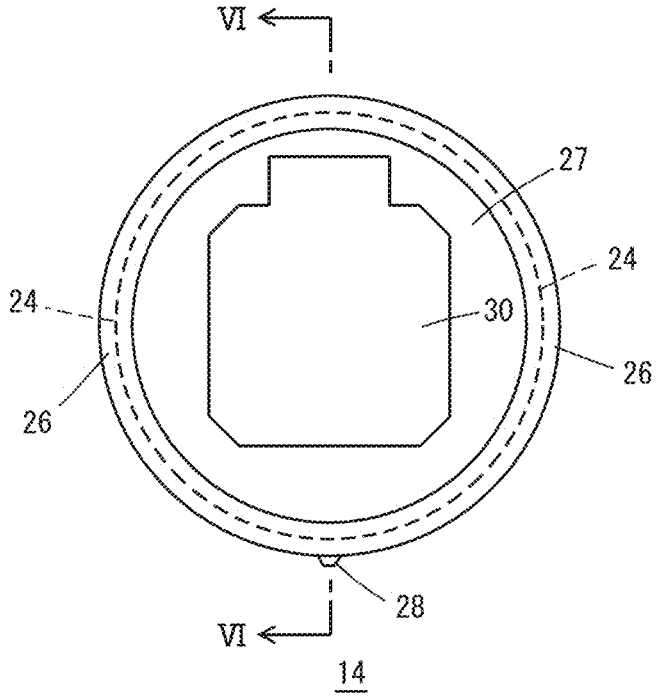
FIG. 4 A front view of the protection member according to the embodiment.
Figure 5:
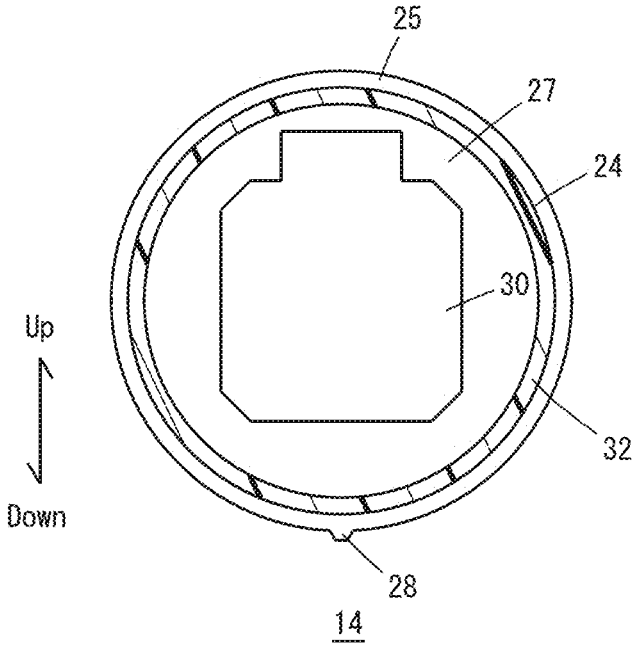
FIG. 5 A cross-sectional view of the protection member in the V-V direction in FIG. 3.
Figure 6:
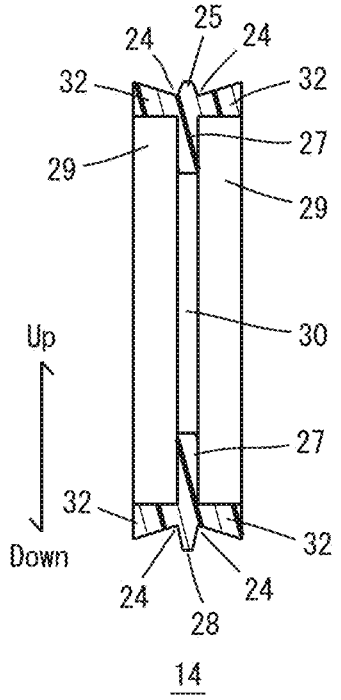
FIG. 6 A cross-sectional view of the protection member in the VI-VI direction in FIG. 4.

The structure of the protection member 14 is shown in FIGS. 4 to 6. The protection member 14 has a plate-like portion 27 at the center part in the axial direction and has circularly cylindrical portions 32 and 32 at both sides of the plate-like portion in the axial direction. Further, within a recess 29 between the cylindrical portion 32 and the plate-like portion 27, one side end of the housing 13 is placed. 26 indicates the side end surface of the cylindrical portion 32 in the axial direction. The plate-like portion 27 has an association hole 30 through which the shaft 8 extends to position the protection member 14 between a pair of the individual ductor rollers 12 and 12. The inner diameter of the cylindrical portion 32 (the diameter of the recess 29) is a bit larger than the outer diameter of the housing 13 and this allows the housing 13 moves back and forth.

On the circular surface of the cylindrical portion 32, there is present a ring-like guide 25 at the central portion in the axial direction, and, at both sides of the ring, there is present a trough 24 that is higher toward the edge portions and lower toward the central portion in the axial direction. The trough 24 prevents mist of the cleaning liquid and so on from scattering when the mist and so on collide. The cleaning liquid adhering on the trough 24 is downward guided by the guide 25 along the trough 24. There is a projection 28 at the lower end of the guide 25, and the cleaning liquid drops from the projection 28 and is discharged into the clearance between the roller members 16, 16.

The functions of the embodiment will be described. The protection members 14 are oil-resistant and have no need for exchange. The inner diameter of the cylindrical portion 32 is a bit larger than the outer diameter of the housing 13 and allows the forward and backward movement of the individual ductor rollers 12. When cleaning the printing machine, the cleaning liquid (the main component is an organic solvent or a machine oil.) is sprayed onto the ductor roller 2, collides the trough 24 through the clearance between the roller members 16, 16, is prevented from scattering toward the housing 13, and is released along the trough 24. At the lower end of the guide 25, the cleaning liquid drops from the projection 28 and falls through the clearance between the roller members 16, 16. Thus, the intrusion of the cleaning liquid to the electromagnetic valves 10 is prevented. While ink mist and other contaminants adhere also on the trough 24, they are released with the cleaning liquid and so on to the outside.

Figure 7:
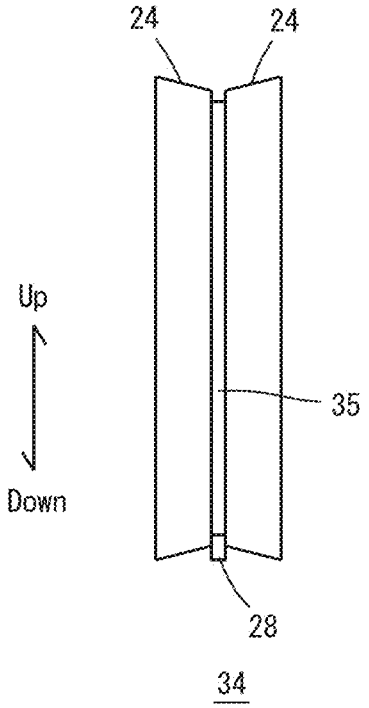
FIG. 7 A side view of another protection member according to a modification.

FIG. 7 indicates another protection member 34 according to a modification. The protection member 34 is provided with a groove at the center portion of the trough 24 to guide the cleaning liquid. In other respects, the protection member 34 is the same as the protection member 14 in FIGS. 1-6.

Figure 8:
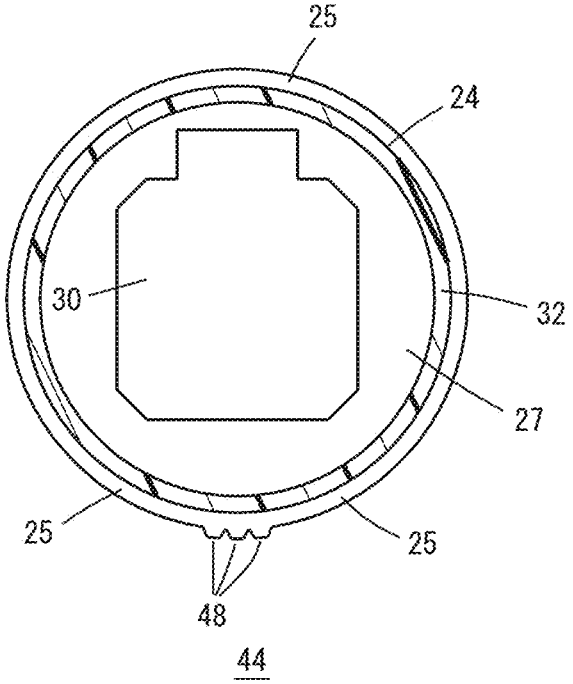
FIG. 8 A cross-sectional view of another protection member according to a second modification.

FIG. 8 indicates another protection member 44 according to a second modification. The protection member 44 has a plurality of projections 48 at the lower end of the guide 25 in order to drop the cleaning liquid. In other words, the projection at the lower end of the trough 24 of the protection members is enough if it receives the cleaning liquid from the guides 25, 35 and drops the cleaning liquid downward. The protection member 44 is the same as the protection member 14 in FIGS. 1-6 in other respects.

Figure 9:
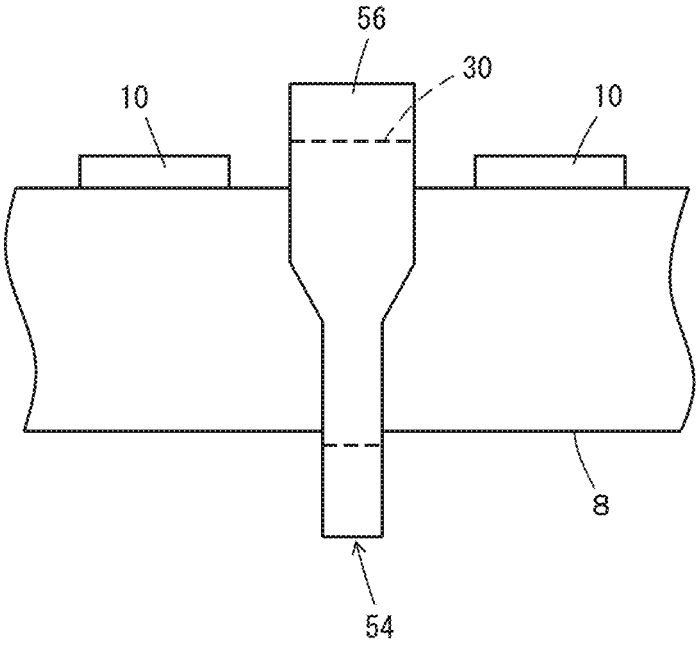
FIG. 9 A view indicating another protection member according to a third modification and individual ductor rollers at the left and right without the roller members.
Figure 10:
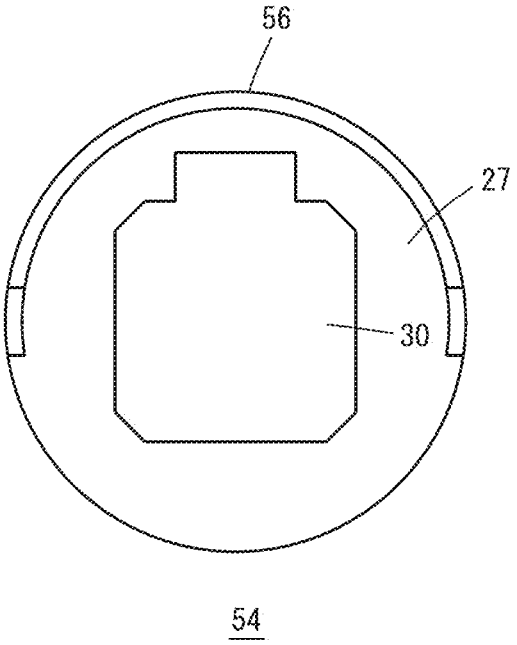
FIG. 10 A front view of the protection member according to the third modification.

FIGS. 9 and 10 indicate another protection member 54 that is not provided with the trough 24, the guide 25, nor the projection 28. The protection member 54 is provided with an arc-like cover 56 at its upper portion; the cover receives the cleaning liquid and drops it from the lower end of the protection member 54.

According to the embodiment, the individual ductor rollers 12 are retracted by the spring 23 and the contact piece 22, but they may be retracted by the pistons 21 retracting pneumatically.

List of the Symbols

| | | | |
|---|---|---|---|
| 2 | ductor roller | 4 | ink fountain roller |
| 6 | ink distribution roller | 8 | shaft |
| 9 | groove | 10 | electromagnetic valve |
| 12 | individual ductor roller | 13 | housing |
| 14 | protection member | 16 | roller member |
| 18 | bearing | 20 | pipe |
| 21 | piston | 22 | contact piece |
| 23 | spring | 24 | trough |
| 25 | guide | 26 | side surface |
| 27 | plate-like portion | 28 | projection |
| 29 | recess | 30 | association hole |
| 32 | cylindrical portion | 34 | protection member |
| 35 | guide | 44 | protection member |
| 48 | projection | 54 | protection member |
| 56 | cover | | |

What is claimed is:

1. A ductor roller for a printing machine, the ductor roller comprising:

a shaft provided with an air supply pipe;

a plurality of individual ductor rollers; and a plurality of electromagnetic valves, wherein the individual ductor rollers and the electromagnetic valves are connected to the shaft, and the individual ductor rollers are advanced pneumatically by said electromagnetic valves, the individual ductor rollers are provided with housings associated with the shaft and configured to move forward and backward; roller members configured to contact an ink fountain roller and an ink distribution roller; and bearing members connecting the roller members to the housings, said electromagnetic valves are located in said housings, and protection members for the electromagnetic valves are located within a clearance between the individual ductor rollers, are oil-resistant, are associated with and supported by the shaft, and are provided with circularly cylindrical covers covering at least upper portions of side ends of said housings, and said circularly cylindrical covers have a trough on an outer circular face of the circularly cylindrical covers and, in an axial direction of said shaft, the trough is lower at a central portion of the circularly cylindrical covers and higher at side end portions of the circularly cylindrical covers.

2. The ductor roller for a printing machine according to claim 1, wherein said protection members further include circular plate-like portions extending vertically with respect to said shaft and having association holes at a center of the circular plate-like portions to receive said shaft therein; and said circularly cylindrical covers are provided on an outer circumference of the circular plate-like portions.

3. The ductor roller for a printing machine according to claim 1, wherein a guide for guiding cleaning liquid for printing machines downward is located at the central portion of the trough in the axial direction.

4. The ductor roller for a printing machine according to claim 1, wherein at least a projection for dropping cleaning liquid for printing machines downward is located at a lower end of the trough.

5. A protection member for protecting an electromagnetic valve in a ductor roller for a printing machine, wherein the ductor roller includes: a shaft provided with an air supply pipe; a plurality of individual ductor rollers comprising housings, bearings, and roller members connected to the housings via the bearings; and a plurality of electromagnetic valves, the individual ductor rollers and the electromagnetic valves are connected to the shaft, the individual ductor rollers are advanced pneumatically by said electromagnetic valves toward an ink fountain roller of the printing machine, and wherein said electromagnetic valves are located in said housings, the protection member comprising:

an association hole for receiving the shaft, and a circularly cylindrical cover for covering at least an upper portion of a side end of the housing of the individual ductor roller and having a trough on an outer circular face of the circularly cylindrical cover, wherein the trough is lower at a central portion of the circularly cylindrical cover and higher at side end portions of the circularly cylindrical cover in an axial direction of the circularly cylindrical cover, and the protection member is oil-resistant.

* * * * *